United States Patent [19]

Salkeld

[11] 4,108,236

[45] Aug. 22, 1978

[54] FLOATING HEAT INSULATING BAFFLE FOR DIRECTIONAL SOLIDIFICATION APPARATUS UTILIZING LIQUID COOLANT BATH

[75] Inventor: Richard W. Salkeld, South Windsor, Conn.

[73] Assignee: United Technologies Corporation, Hartford, Conn.

[21] Appl. No.: 789,752

[22] Filed: Apr. 21, 1977

[51] Int. Cl.[2] ..... B22D 27/04

[52] U.S. Cl. ..... 164/338 R; 164/60; 164/128

[58] Field of Search ..... 164/60, 122, 126, 127, 164/128, 338, 348, 361

[56] References Cited

U.S. PATENT DOCUMENTS

| | | | |
|---|---|---|---|
| 3,584,676 | 6/1971 | Busquet et al. | 164/60 |
| 3,635,279 | 1/1972 | Matsunaga et al. | 164/128 X |
| 3,714,977 | 2/1973 | Terkelsen | 164/60 |
| 3,763,926 | 10/1973 | Ischinkel et al. | 164/60 X |

*Primary Examiner*—Robert L. Spicer, Jr.
*Attorney, Agent, or Firm*—Edward J. Timmer

[57] ABSTRACT

An improved casting apparatus for directionally solidifying molten metal is disclosed. The apparatus typically includes a furnace for heating a mold containing molten metal, a liquid metal coolant bath positioned below the bottom of the furnace and means for gradually withdrawing the heated mold from the furnace into the coolant bath to effect directional solidification of the molten metal. The apparatus is improved by positioning a heat insulating baffle between the bottom of the furnace and coolant bath, the baffle being constructed to float on the bath surface during the solidification process and minimize heat loss from the mold until it is immersed in the bath. The provision of the floating baffle between the furnace bottom and coolant bath provides several important advantages including increased thermal gradients, shorter casting cycles and improved cast microstructures. In addition, the floating baffle reduces vaporization of the liquid metal coolant and maintains a smooth, ripple-free coolant surface.

6 Claims, 1 Drawing Figure

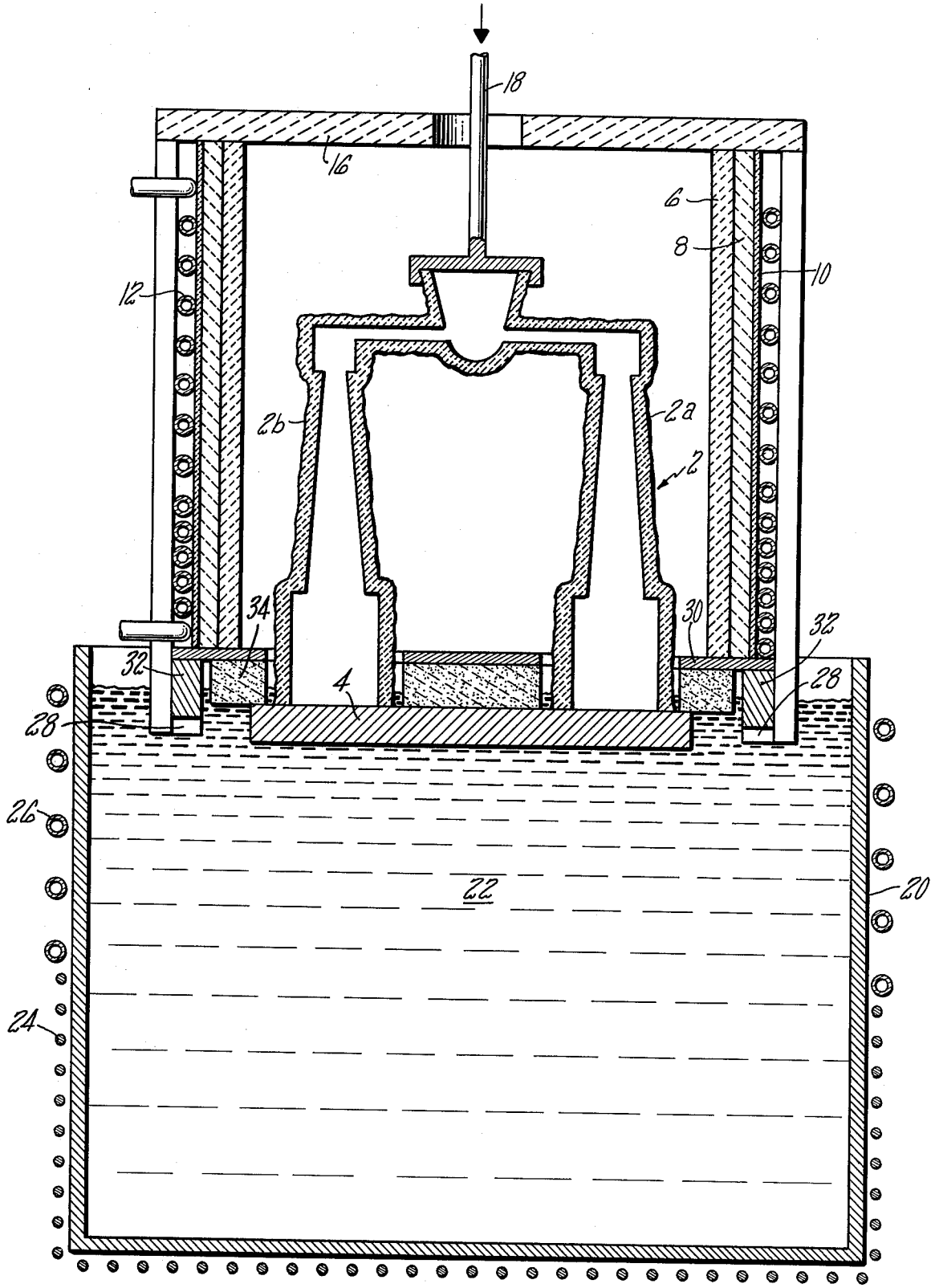
18
16
6
8
10
12
2b
2a
2
34
30
32
32
28
4
28
26
22
20
24

FLOATING HEAT INSULATING BAFFLE FOR DIRECTIONAL SOLIDIFICATION APPARATUS UTILIZING LIQUID COOLANT BATH

BACKGROUND OF THE INVENTION

1. Field of the Invention

The present invention relates to directional solidification apparatus and, more particularly, to high rate directional solidification apparatus employing a liquid cooling bath.

2. Description of the Prior Art

U.S. Pat. No. 3,763,926, of common assignee herewith, discloses an apparatus and process for casting directionally solidified articles at high rates. In the process, a mold resting on a chill plate is heated to an elevated temperature in the heating zone of a furnace, molten metal is then introduced into the heated mold and the mold is gradually withdrawn from the heating zone into a liquid cooling bath, such as molten tin at 500° F. Heat removal through both the chill plate and mold walls establishes a steep thermal gradient in the molten metal and results in unidirectional solidification. Although the apparatus and process of the subject patent have proved highly successful, improvements allowing higher thermal gradients to be achieved in the mold, shorter casting cycles and improved cast microstructures are nevertheless deemed very desirable.

SUMMARY OF THE INVENTION

The present invention has as its primary object the achievement of these and other improvements.

The present invention provides an improved casting apparatus characterized by the placement of a heat insulating baffle between the bottom of the furnace from which the mold is withdrawn and the liquid coolant bath, the baffle being constructed to have a density less than that of the liquid coolant so that it floats on the bath surface during the solidification process and minimizes heat loss from the mold until the mold is immersed in the liquid coolant. The baffle typically includes one or more openings which are aligned beneath one or more openings in the furnace bottom to permit continuous withdrawal of the molds from the furnace, through the baffle and into the liquid coolant bath. Preferably, the baffle openings are suitably contoured to closely conform to the outer mold walls during withdrawal.

The provision of the floating heat insulating baffle between the furnace and liquid coolant bath results in several important advantages among which are an increased thermal gradient in the molten metal and corresponding increased solidification rate, reduced casting time and improved microstructure, these advantages being available regardless of whether a single mold or a multiple mold cluster is utilized. In addition, vaporization of the liquid coolant is reduced while, at the same time, a smooth, ripple-free coolant bath surface is maintained for uniform cooling of the metal.

These and other objects and advantages of the present invention will become apparent from the following drawing and detailed description of the preferred embodiment.

BRIEF DESCRIPTION OF THE DRAWING

The FIGURE shows a typical casting apparatus according to the invention, the floating heat insulating baffle being positioned between the furnace and coolant bath.

DESCRIPTION OF THE PREFERRED EMBODIMENT

Referring to the FIGURE, the mold 2, which is shown as a gang mold for the production of two or more directionally solidified articles at one time, is positioned on a chill plate 4 and is located within a heating furnace which includes a cylinder in the form of a graphite susceptor 6, the latter surrounded in turn by one or more graphite felt sleeves 8 for insulation purposes and a surrounding insulating ceramic cylinder 10 which may be a quartz fiberboard sleeve. Outside of the cylinder 10 is an induction coil 12 for heating the susceptor, the coil preferably being more closely spaced at the bottom of the furnace than at the top, as shown, to provide more uniform heating along the length of the cylindrical chamber defined by the susceptor. A suitable insulating cover 16 may be positioned on the upper end of the susceptor overlying the cylindrical heating chamber defined thereby. Suitable means are provided for moving the chill plate downwardly to withdraw the mold out of the cylindrical heating chamber, for example, withdrawal rod 18 in combination with any conventional actuating means as, for example, hydraulic devices, may be utilized to effect mold withdrawal.

Positioned below the heating furnace is a tank 20 which holds cooling liquid 22, such as molten tin at 500° F. The tank 20 may have heating elements 24 surrounding it for raising the temperature of the bath to that desired for immersion and cooling of the mold and the tank may also include cooling coils 26 therearound near the upper end for the purpose of maintaining the desired temperature within the bath of liquid, especially as the hot mold is immersed during the solidification process. Although not shown, suitable stirring means may be provided to circulate the liquid coolant around the mold as it is gradually immersed in the bath. Generally, the heating furnace and coolant tank are enclosed within a suitable vacuum chamber.

The heating furnace and related apparatus are supported above the liquid coolant bath on posts 28 which may be attached to the tank 20 or other external supports. A radiation shield 30 in the form of a disc located at the base of the susceptor sleeve 6, insulating sleeve 8 and cylinder 10 projects inwardly and has openings therein large enough to permit downward motion of the mold. This radiation shield may be supported together with the susceptor sleeve and other parts of the apparatus by heat resistant blocks 32 attached to the posts 28. The shield may be of some refractory material such as tantalum, grafoil and the like and serves to prevent direct heat radiation to the chill plate and the mold as it is being withdrawn.

According to the present invention, a heat insulating baffle 34 is placed between the bottom of the heating furnace and the coolant bath, the baffle being constructed of heat insulating material to have a density less than that of the liquid coolant so that it floats on the coolant bath surface as shown. A disc-shaped, heat insulating baffle constructed of a fibrous zirconia insulating core, such as Zircar® available from Zircar Products Inc., bonded in a sandwich type arrangement between heat resistant grafoil sheets has been found to provide an extremely buoyant baffle in molten tin at 500° F. Of course, other suitable insulating materials and construction techniques may be utilized as desired.

The baffle typically includes one or more openings therein to permit passage of the individual article molds *2a* and *2b* therethrough as the gang mold is withdrawn from the bottom of the furnace into the coolant bath, the number of openings varying with the number of article molds. As shown, the baffle openings are axially aligned beneath the corresponding openings in the furnace bottom, that is, the openings in the radiation shield 30. Axial alignment of the baffle openings can be readily achieved by designing the floating baffle to fit snuggly between heat resistant blocks 32. Although the openings in the floating baffle may have any simple cross-sectional shape, such as circular, it is oftentimes desirable to provide contoured openings which conform relatively closely to the outer walls of the article molds.

In solidifying molten metal simultaneously in a plurality of article molds, such as in the gang or cluster mold illustrated in the FIGURE, it has been found convenient to provide the floating insulating baffle in two cooperating components, namely, an outer floating annular member and an inner floating circular member positioned within the central hole of the annular member. Of course, one or both of the floating members may define the openings through which the article molds are withdrawn toward the coolant bath.

Functionally, the floating heat insulating baffle effectively reduces heat loss from the mold until it is immersed in the cooling bath, which reduction provides a sharp line of demarcation between heated and cooled portions of the mold and increases the thermal gradient therein, thereby increasing solidification rates and reducing casting cycle time. In effect, the baffle reduces the distance between the hot furnace chamber and cooling bath surface. Furthermore, spurious nucleation on the mold walls is effectively inhibited by the increased thermal gradient and provides improved directionally solidified microstructures. The floating baffle also minimizes heat radiation to the coolant surface and thereby significantly reduces vaporization of the coolant during the solidification process. A smooth, ripple-free coolant surface is maintained as a result of the floating baffle stifling any surface turbulence generated by immersion of the mold and by circulation of the coolant therearound. The result is more uniform cooling around the mold periphery and improved cast microstructures. Importantly, all of the advantages associated with the invention are available regardless of whether a single mold or multiple mold cluster, as illustrated, is used.

The present invention is especially useful in directional solidification processes such as described in VerSnyder, U.S. Pat. No. 3,260,505 and Piearcey, U.S. Pat. No. 3,494,709 for columnar and single crystal castings, respectively. It also is especially useful in solidifying eutectic compositions such as according to the Lemkey, U.S. Pat. No. 3,793,100.

Of course, those skilled in the art will recognize that other changes, omissions and additions in the form and detail of the preferred embodiment may be made without departing from the spirit and scope of the invention.

I claim:

1. In a casting apparatus for the directional solidification of molten metal wherein the apparatus includes a heating furnace having an open end through which a heated mold containing molten metal is withdrawn, a liquid cooling bath positioned beneath the open end of the furnace and means for gradually withdrawing the heated mold from the furnace, through the open end and immersing it in the cooling bath, the improvement comprising:

a heat insulating baffle positioned between the open end of the furnace and the liquid cooling bath, the baffle being constructed to have a density less than that of the liquid coolant so that it floats on the bath surface during the solidification process, the baffle having at least one opening therethrough aligned beneath the open furnace end to permit mold withdrawal from the furnace, through the baffle and into the cooling bath, the baffle surrounding the mold as it is withdrawn toward the cooling bath to minimize heat loss therefrom until the mold is immersed, said minimization of heat loss substantially improving the thermal gradient in the mold, said floating baffle also reducing vaporization of the liquid coolant during mold withdrawal and providing a smooth bath surface for uniform cooling.

2. The apparatus of claim 1 wherein the opening in the baffle conforms closely to the outer wall configuration of the mold.

3. The apparatus of claim 1 wherein the floating baffle comprises a sandwich construction in which an insulating core is held between heat resistant sheets.

4. The apparatus of claim 1 wherein the furnace includes a cylindrical susceptor and induction coil therearound to heat the susceptor.

5. The apparatus of claim 4 wherein the floating insulating baffle includes an outer floating annular member and an inner floating circular member, said circular member being cooperatively positioned within the annular member, at least one of said members defining the opening through which the mold passes.

6. The apparatus of claim 1 wherein the liquid cooling bath is molten tin.

* * * * *